US008552916B2

(12) United States Patent
Hossain et al.

(10) Patent No.: US 8,552,916 B2
(45) Date of Patent: Oct. 8, 2013

(54) ANTENNA AND RADIO COMMUNICATION APPARATUS

(75) Inventors: Md. Golam. Sorwar Hossain, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 395 days.

(21) Appl. No.: 12/889,689

(22) Filed: Sep. 24, 2010

(65) Prior Publication Data

US 2011/0128200 A1 Jun. 2, 2011

(30) Foreign Application Priority Data

Nov. 27, 2009 (JP) ..... 2009-269934

(51) Int. Cl.
*H01Q 9/00* (2006.01)

(52) U.S. Cl.
USPC ..... 343/745

(58) Field of Classification Search
USPC ..... 343/745
See application file for complete search history.

(56) References Cited

U.S. PATENT DOCUMENTS

| | | | | |
|---|---|---|---|---|
| 5,828,340 | A * | 10/1998 | Johnson | 343/700 MS |
| 6,693,594 | B2 * | 2/2004 | Pankinaho et al. | 343/700 MS |
| 2002/0018065 | A1 | 2/2002 | Tobita et al. | |
| 2004/0027288 | A1 | 2/2004 | Okubora et al. | |
| 2004/0041734 | A1 | 3/2004 | Shiotsu et al. | |
| 2006/0097918 | A1 | 5/2006 | Oshiyama et al. | |
| 2006/0197711 | A1 | 9/2006 | Sekiguchi et al. | |
| 2006/0279469 | A1 | 12/2006 | Adachi et al. | |
| 2007/0021659 | A1 | 1/2007 | DeLonzor et al. | |
| 2009/0167617 | A1 | 7/2009 | Nishio | |
| 2009/0284433 | A1 | 11/2009 | Tsutsumi et al. | |
| 2010/0053007 | A1 * | 3/2010 | Ni et al. | 343/745 |

FOREIGN PATENT DOCUMENTS

| | | |
|---|---|---|
| EP | 1 361 623 | 11/2003 |
| EP | 1 569 298 | 8/2005 |
| EP | 1 594 186 | 11/2005 |
| JP | 2002-261533 | 9/2002 |
| JP | 2004-253943 | 9/2004 |
| JP | 2004-320611 | 11/2004 |
| JP | 2005-102101 | 4/2005 |
| JP | 2006-345042 | 12/2006 |
| JP | 2007-194995 | 8/2007 |
| JP | 2007-522769 | 8/2007 |
| JP | 2008-123231 | 5/2008 |
| JP | 2008-141661 | 6/2008 |
| JP | 2009-278535 | 11/2009 |
| JP | 4508190 | 5/2010 |

(Continued)

OTHER PUBLICATIONS

European Search Report dated Jun. 9, 2011, from corresponding European Application No. 10 18 7536.

(Continued)

*Primary Examiner* — Jerome Jackson, Jr.
*Assistant Examiner* — Hai Tran
(74) *Attorney, Agent, or Firm* — Katten Muchin Rosenman LLP

(57) ABSTRACT

An antenna includes a first arm whose one end is connected to a feeding unit, a second arm whose one end is connected to the first arm at a position that is away from the one end of the first arm and whose other end is connected to ground, and a variable impedance unit whose impedance is variable, provided between the ground and the other end of the first arm.

3 Claims, 13 Drawing Sheets

(56) References Cited

FOREIGN PATENT DOCUMENTS

| | | |
|---|---|---|
| JP | 2010-239246 | 10/2010 |
| WO | 2005/078916 | 8/2005 |
| WO | 2006/080141 | 8/2006 |

OTHER PUBLICATIONS

C.M. Coleman, et al. "Self-Structuring Antennas" IEEE Antennas and Propagation Magazine, vol. 44, No. 3, Jun. 1, 2002, pp. 11-23.
Japanese Office Action dated May 14, 2013, from corresponding Japanese Application No. 2009-269934.

* cited by examiner

ANTENNA AND RADIO COMMUNICATION APPARATUS

CROSS-REFERENCE TO RELATED APPLICATION

This application is based upon and claims the benefit of priority of the prior Japanese Patent Application No. 2009-269934, filed on Nov. 27, 2009, the entire contents of which are incorporated herein by reference.

FIELD

The embodiments discussed herein are related to an antenna and a radio communication apparatus.

BACKGROUND

At present, radio communication systems such as cellular phone systems or wireless local area networks (wireless LANs) are widely used. In the standards body for radio communications, a lively discussion about the next-generation radio communication standards has been performed to further improve a communication speed and communication capacity. For example, in the 3rd generation partnership project (3GPP), a discussion is held regarding the radio communication standards referred to as so-called long term evolution (LTE) or long term evolution-advanced (LTE-A).

In such a radio communication system, a wider bandwidth of a frequency band used for the radio communication system is promoted. Further, some radio communication systems perform a communication (multiband communication) using a plurality of frequency bands. For example, a wide frequency band of 600 MHz to 6 GHz is possibly used in the next-generation radio communication standards. In this case, the radio communication apparatus adapted to the standards includes an antenna adaptable for the above-described wide frequency band. On the other hand, miniaturization and weight saving may be demanded for a portable radio communication apparatus such as a cellular phone.

For an antenna used for the radio communication, there is proposed a gate antenna device that suppresses power consumption or leakage electric fields, expands a communication range with an IC-integrated medium, and improves communication accuracy. This gate antenna device has a power-fed loop antenna to which a signal current is supplied and a non-power-fed loop antenna to which a signal current is not supplied (e.g., Japanese Laid-open Patent Publication No. 2005-102101).

Further, there is proposed a radio frequency identification (RFID) tag reading system capable of easily setting a shape of a reading area where an RFID tag is readable. This RFID tag reading system includes a first antenna that is connected to a reading device via a feeding wire, a second antenna that is located rightly in the radiation direction of the first antenna, and a third antenna that is connected to the second antenna via a feeding wire (e.g., Japanese Laid-open Patent Publication No. 2008-123231).

Further, the applicant performs an application for a patent (Japanese Patent Application No. 2009-82770) about an antenna capable of adjusting an operating frequency in combination of a monopole antenna and a loop antenna. However, the antenna described in this application for a patent can stand improvement about the tuning of an operating frequency, particularly, the tuning of a low frequency side. A circuit for a portion in which an electric loop is formed makes easy the tuning of a high frequency side and also, preferably makes easy the tuning of a low frequency side with respect to a desired operating frequency.

SUMMARY

According to one aspect of the present invention, this antenna includes a first arm unit whose one end is connected to a feeding unit; a second arm unit whose one end is connected to the first arm unit at a position that is away from the one end of the first arm unit and whose other end is connected to ground; and a variable impedance unit whose impedance is variable, provided between the ground and the other end of the first arm unit.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
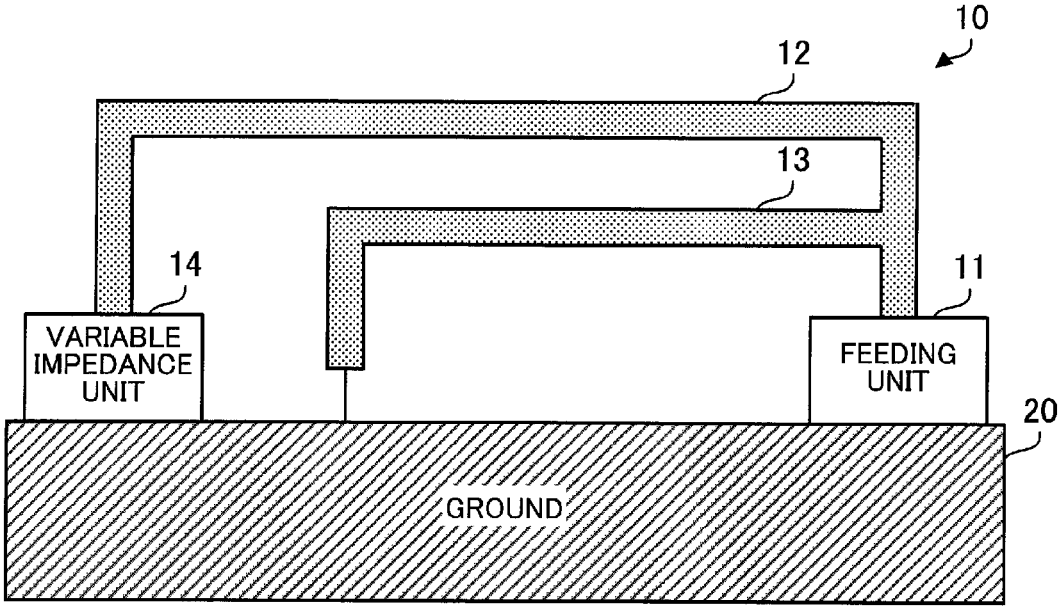
FIG. 1 illustrates an antenna according to a first embodiment.

Preferred embodiments of the present invention will now be described in detail below with reference to the accompanying drawings, wherein like reference numerals refer to like elements throughout.

(First Embodiment)

FIG. 1 illustrates an antenna according to a first embodiment. The illustrated antenna 10 has a feeding unit 11, an arm 12 (a first arm unit), another arm 13 (a second arm unit), and a variable impedance unit 14.

The feeding unit 11 supplies power of a transmitter (not illustrated) to the arms 12 and 13 as well as transfers to a receiver (not illustrated) power generated by capturing radio waves by the arms 12 and 13. The feeding unit 11 is also referred to as an antenna feeder. The feeding unit 11 is connected to ground 20. Another circuit may be inserted between the feeding unit 11 and the ground 20. Further, a matching circuit for taking impedance matching may be connected to the feeding unit 11.

The arm 12 is an electric conductor in which one end is connected to the feeding unit 11 and the other end is connected to the variable impedance unit 14. In an example of FIG. 1, the arm 12 has two short sides that are perpendicular to or almost perpendicular to an end side of the ground 20, and one long side that is parallel to or almost parallel to the end side of the ground 20. In other words, the arm 12 is bent at a right angle or almost at a right angle at two points between the feeding unit 11 and the variable impedance unit 14. Note that a shape of the arm 12 is not limited to the above-described shape.

The arm 13 is an electric conductor in which one end is connected to the arm 12 at a position that is away from the end of the arm 12 and the other end is connected to the ground 20. In an example of FIG. 1, one end of the arm 13 is connected to the short side of the arm 12 at a position that is away from the one end thereof connected to the feeding unit 11. Further, the arm 13 has one long side that is parallel to or almost parallel to the end side of the ground 20, and one short side that is perpendicular to or almost perpendicular to an end side of the ground 20. In other words, the arm 13 is bent at a right angle or almost at a right angle at one point between a branch point to the arm 12 and a ground point to the ground 20. Note that a shape of the arm 13 is not limited to the above-described shape.

As described above, an electric loop is formed by a part of the arm 12, the arm 13, and the ground 20. Another circuit may be inserted between an end of the arm 13 and the ground 20. For example, a switch bank unit for selecting from among a plurality of candidates of ground points as a ground point of an end of the arm 13 is considered to be provided. In this case, the switching of a switch permits a loop length to be variable and a resonance frequency due to the electric loop to be variable.

In addition, a height (e.g., a distance between a long side of the arm 12 and an end side of the ground 20) of the arm 12 from the ground 20 may be set to be larger than that (e.g., a distance between a long side of the arm 13 and an end side of the ground 20) of the arm 13 from the ground 20. Further, on the ground 20, a distance between the feeding unit 11 and the variable impedance unit 14 may be set to be larger than that between the feeding unit 11 and a ground point of the arm 13. For example, the ground point of the arm 13 is considered to be provided between the feeding unit 11 and the variable impedance unit 14. This realizes miniaturization of the antenna 10.

The variable impedance unit 14 is provided between the ground 20 and the other end of the arm 12 that is not connected to the feeding unit 11. The variable impedance unit 14 can change impedance. The variable impedance unit 14 can be realized as, for example, an LC resonance circuit (also referred to as an LC tank). In this case, a variable capacitor capable of changing electrostatic capacity, such as a variable capacitance diode can be included in the LC resonance circuit. The change of the electrostatic capacity permits impedance to be variable, and another resonance frequency different from the resonance frequency due to the electric loop to be variable. Note that if the variable impedance unit 14 is enough to change the impedance, it is not limited to the LC resonance circuit.

According to the above-described antenna 10, the electric loop formed between the arm 13 and the ground 20 functions as a loop antenna. Therefore, a large current flows on a surface of the arm 13 at the resonance frequency corresponding to the loop length. When the switch bank unit is connected to the arm 13, the resonance frequency can be changed by switching a switch.

On the other hand, a combination of the arms 12 and 13 functions also as an inverted-F antenna. Specifically, the arm 12 functions as a radiant section of the inverted-F antenna, and on the other hand, the arm 13 functions as a short-circuiting section of the inverted-F antenna. Therefore, a large current flows on surfaces of the arms 12 and 13 at a resonance frequency different from the resonance frequency due to the electric loop. On this occasion, by the variable impedance unit 14 adjusting the impedance, the resonance frequency can be changed. The above-described resonance frequency can be tuned separately from the resonance frequency due to the electric loop, and the tuning over a wide range of frequencies becomes easy. As a result, the antenna 10 is suitable for a broadband antenna.

When the antenna 10 has, for example, a shape illustrated in FIG. 1, a loop antenna realized by the arm resonates at a relatively high frequency and an inverted-F antenna realized by the arms 12 and 13 resonates at a relatively low frequency. Accordingly, the variable impedance unit 14 can tune the resonance frequency of the low frequency side separately from the resonance frequency of the high frequency side.

The antenna 10 can be used as any one of a receiving antenna, a transmitting antenna, and a transmitting-receiving antenna. The antenna 10 can be mounted on a radio terminal device. Particularly, since the miniaturization of the antenna 10 is easily realized, the antenna 10 is suitable for the radio terminal device such as a cellular phone and a mobile terminal device. For example, the antenna 10 can be mounted on the radio communication apparatus adaptable to standards of LTE or LTE-A. In this case, when arm lengths of the arms 12 and are adjusted, the antenna 10 is also adaptable to a broad frequency band of 600 MHz to 6 GHz. When changing a software defined radio (SDR), namely, control software, a radio communication capable of switching a wireless communication method is easily realized.

According to a second embodiment described below, an example where the antenna 10 according to the first embodiment is applied to the radio communication apparatus will be described. Note that the above-described antenna 10 is not limited to a specific shape illustrated in FIG. 1 or a specific shape described in the second embodiment.

(Second Embodiment)

Figure 2:
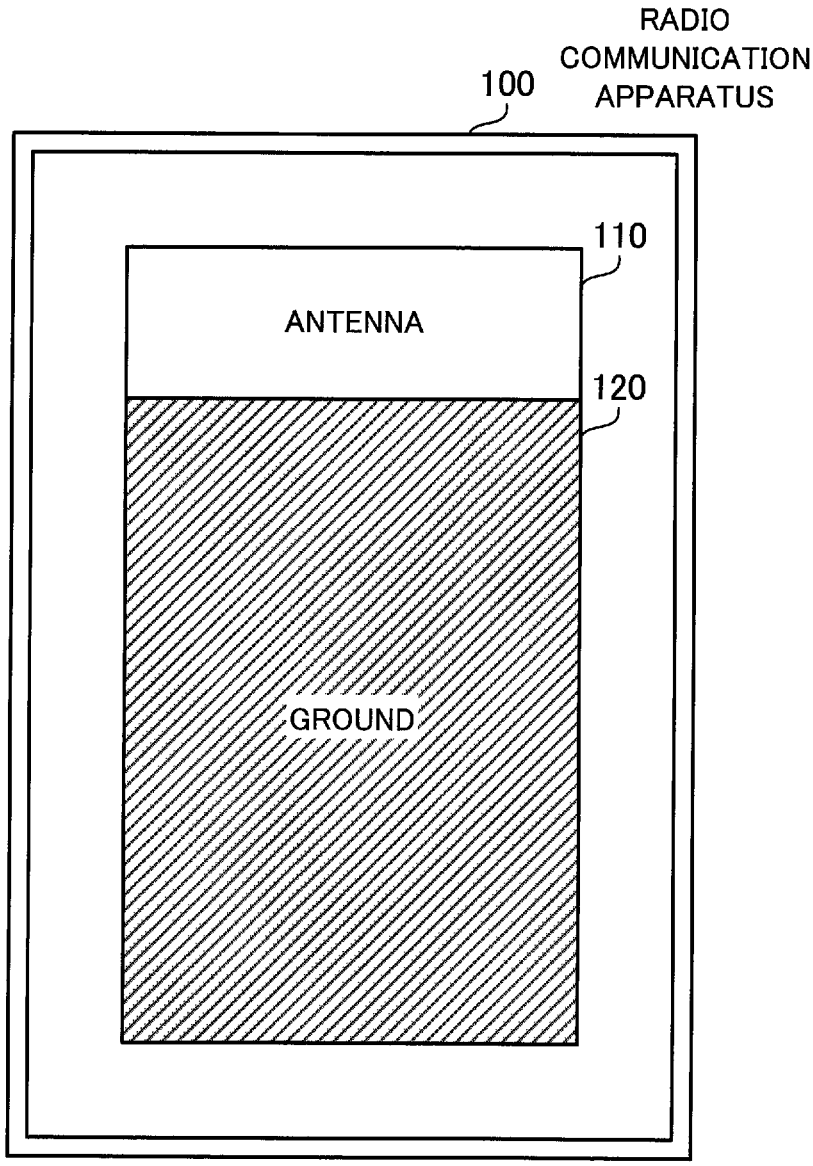
FIG. 2 illustrates a radio communication apparatus according to a second embodiment.

FIG. 2 illustrates the radio communication apparatus according to the second embodiment. The radio communication apparatus 100 has an antenna 110 and a ground 120. The antenna 110 is a transmitting-receiving antenna. The antenna 110 radiates radio-frequency energy into space as radio waves and captures the radio waves in space to convert them into the radio-frequency energy. The ground 120 is set to an earth potential and is connected to the antenna 110.

Both of the antenna 110 and the ground 120 can be formed on one surface of a printed circuit board included in the radio communication apparatus 100. This eliminates the need for installing a member of the antenna 110 on the other region of the surface of the printed circuit board, and a region of the surface of the printed circuit board can be effectively used. Accordingly, miniaturization of the radio communication apparatus 100 is easily realized.

Figure 3:
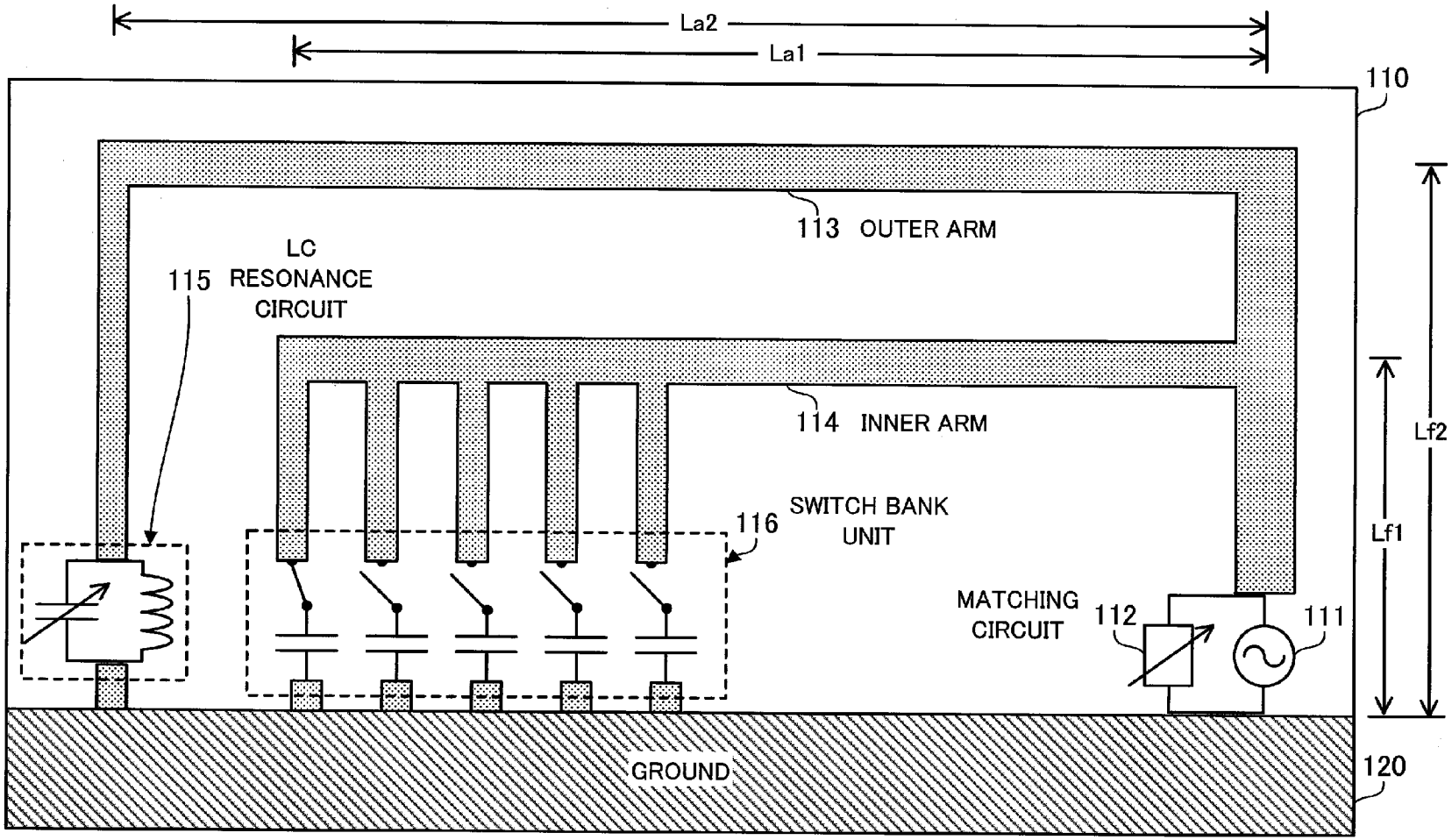
FIG. 3 illustrates an antenna according to the second embodiment.

FIG. 3 illustrates the antenna according to the second embodiment. The illustrated antenna 110 has a feeding unit 111, a matching circuit 112, an outer arm 113, an inner arm 114, an LC resonance circuit 115, and a switch bank unit 116. The above-described units of the antenna 110 can be formed with one layer on one surface of the printed circuit board.

The feeding unit 111 supplies power of a transmitter (not illustrated) to the outer arm 113 and the inner arm 114, and transfers to a receiver (not illustrated) power generated by capturing radio waves by using the outer arm 113 and the inner arm 114. The feeding unit 111 is connected to the ground 120. The feeding unit 111 is regarded as one example of the feeding unit 11 according to the first embodiment.

The matching circuit 112 is a circuit for taking impedance matching between the outer arm 113, the inner arm 114, and the feeding unit 111. The matching circuit 112 is connected to the feeding unit 111. The matching circuit 112 can be realized, for example, by an LC resonance circuit including a variable capacitor such as a variable capacitance diode.

The outer arm 113 is an electric conductor in which one end is connected to the feeding unit 111 and the other end is connected to the LC resonance circuit 115. The outer arm 113 has two short sides perpendicular to an end side of the ground 120 and a long side parallel to the end side of the ground 120. The outer arm 113 is bent at a right angle at two points between the matching circuit 112 and the LC resonance circuit 115. The outer arm 113 (first arm unit) is regarded as one example of the arm 12 according to the first embodiment.

The inner arm 114 is an electric conductor in which one end is connected to the short side of the outer arm 113 at a position that is away from the one end thereof connected to the feeding unit 111, and the other end is connected to the ground 120 via the switch bank unit 116. The inner arm 114 has a short side perpendicular to the end side of the ground 120 and a long side parallel to the end side of the ground 120. The inner arm 114 is bent at a right angle at one point between a branch point to the outer arm 113 and the switch bank unit 116. The inner arm 114 is regarded as one example of the arm 13 (second arm unit) according to the first embodiment.

Here, a long side of the inner arm 114 extends in the same direction as that of the long side of the outer arm 113 from the short side of the feeding unit 111 side of the outer arm 113. A ground point of the inner arm 114 to the ground 120 is provided between the feeding unit 111 and the LC resonance circuit 115. This permits miniaturization of the antenna 110 to be easily realized.

When a length of the long side of the outer arm 113 is set to La2 and a distance from the end side of the ground 120 to the long side of the outer arm 113 is set to Lf2, an arm length of the outer arm 113 can be defined as $L2=La2+2\times Lf2$. Further, when a length of the long side of the inner arm 114 is set to La1 ($La1<La2$) and a distance from the end side of the ground 120 to the long side of the inner arm 114 is set to Lf1 ($Lf1<Lf2$), a maximum loop length of the electric loop formed by the inner arm 114 and the ground 120 can be defined as $L1=2\times La1+2\times Lf1$.

The LC resonance circuit 115 is a circuit capable of changing the impedance, and is provided between the ground 120 and the outer arm 113. As seen in FIG. 3, one end of the LC resonance circuit 115 is connected to one end of the outer arm 113 that is opposite to the point at which the outer arm 113 is connected to the feeding unit 111. The other end of the LC resonance circuit 115 is connected directly to the ground. The LC resonance circuit 115 includes a variable capacitor such as a variable capacitance diode. When changing the electrostatic capacitance, the LC resonance circuit 115 can adjust the impedance. The LC resonance circuit 115 may include a plurality of capacitors in a series connection. The LC resonance circuit 115 is regarded as one example of the variable impedance unit 14 according to the first embodiment.

The switch bank unit 116 is a circuit capable of switching a ground point, and is provided between the ground 120 and the inner arm 114. As seen in FIG. 3, the inner arm 114 has a plurality of ends opposite to the point at which the inner arm 114 arm is connected to the outer arm 113. The switch bank unit 116 includes a plurality of capacitor switches that are placed between the plurality of ends of the inner arm 114 and different positions on the ground 120. Each switch can be turned on or off independently. In the example of FIG. 3, the switch bank unit 116 includes five switches, but the number of switches may vary.

When any one of the switches is turned on, the inner arm 114 is connected to the ground 120 via a capacitor and an electric loop is formed between the inner arm 114 and the ground 120. A loop length of this electric loop is different depending on a switch to be turned on. When a switch that is farthest from the feeding unit 111 is turned on, a loop length becomes a maximum loop length L1. When the other switches are turned on, each loop length is shorter than the maximum loop length L1. Note that if the switch bank unit 116 is enough to switch a ground point, it is not limited to a configuration illustrated in FIG. 3.

Here, the electric loop formed between the inner arm 114 and the ground 120 functions as a loop antenna. A large current is generated on a surface of the inner arm 114 at the resonance frequency (the resonance frequency of a high frequency side) according to the loop length. The resonance frequency of the high frequency side can be changed by a switch operation of the switch bank unit 116.

On the other hand, a combination of the outer arm 113 and the inner arm 114 functions as an inverted-F antenna. Accordingly, a large current is generated on surfaces of the outer arm 113 and the inner arm 114 at a resonance frequency (a resonance frequency of the low frequency side) different from the resonance frequency due to the electric loop. The resonance frequency of the low frequency side can be changed by an operation of an electrostatic capacitance of the LC resonance circuit 115.

As described above, the antenna 110 has two resonance frequencies of the low frequency side and the high frequency side, and both of the resonance frequencies can be tuned separately. Here, the outer arm 113 is short-circuited by the LC resonance circuit 115 and the electric loop appears to be formed also between the outer arm 113 and the ground 120. However, since an electric loop with a smaller loop length is formed within the above-described electric loop, the outer arm 113 fails to function as a loop antenna. In other words, the outer arm 113 is prevented from functioning as a loop antenna due to the presence of the inner arm 114.

The arm length L2 of the outer arm 113 and the maximum loop length L1 of the electric loop may be adjusted in consideration of respective desired resonance frequencies of the low frequency side and the high frequency side. Since the outer arm 113 has a nature of a monopole antenna, when a resonance wavelength of the low frequency side is set to $\lambda 2$, a relationship of $L2\sim\lambda 2\div 4$ holds (symbol "~" means an approximation). On the other hand, when a resonance wavelength of the high frequency side is set to $\lambda 1$, a relationship of $L1\sim\lambda 1$ holds.

Figure 4:
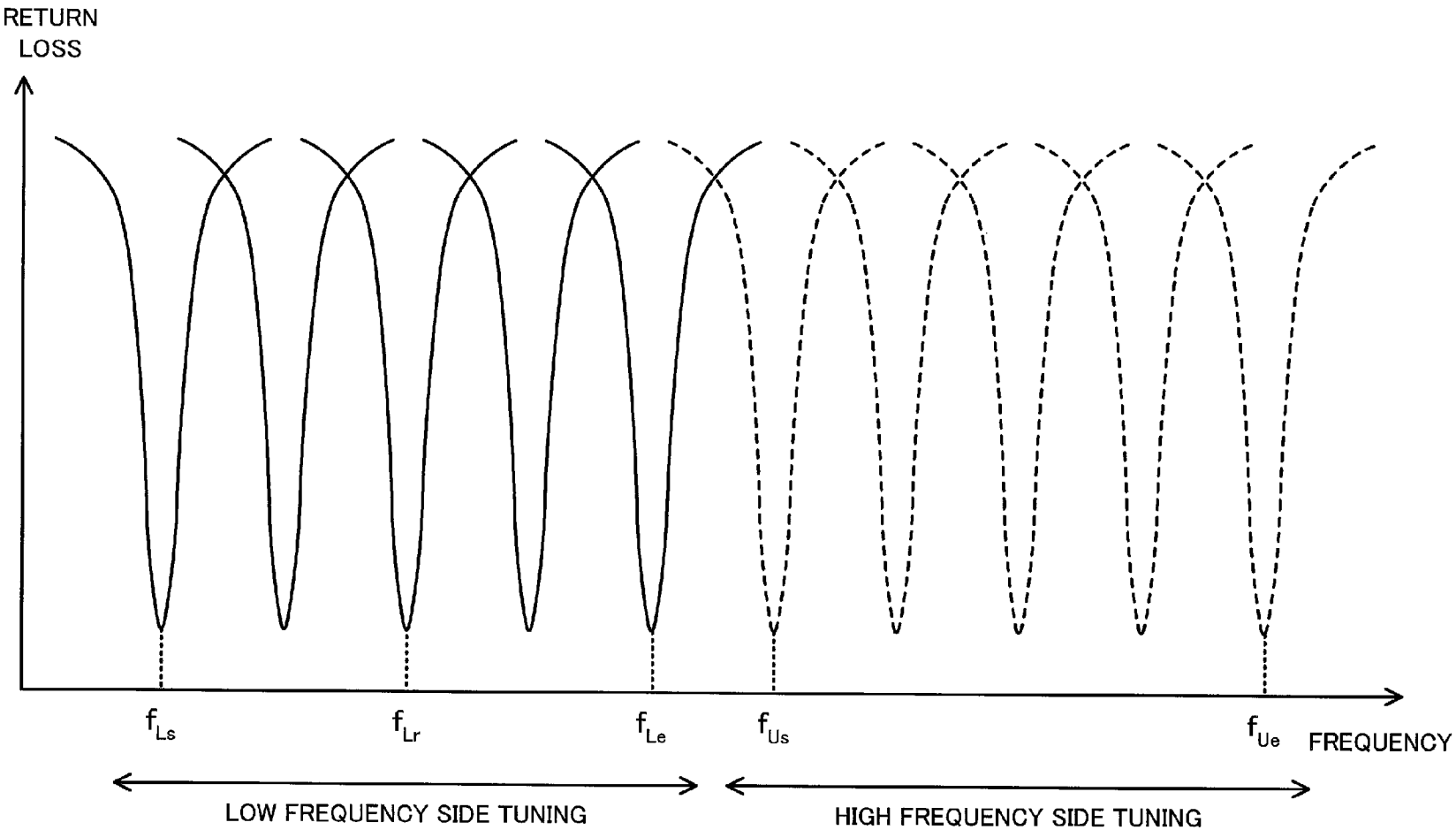
FIG. 4 illustrates a relationship between a frequency and return loss.

FIG. 4 illustrates a relationship between the frequency and the return loss. As described above, in the antenna 110, the resonance frequency of the high frequency side can be tuned by an operation of the switch bank unit 116. On the other hand, the resonance frequency of the low frequency side can be tuned by an operation of the LC resonance circuit 115. In an example of FIG. 4, there is illustrated a case where five ways (collectively, ten ways) of the resonance frequency are switched in each of the high frequency side and the low frequency side. For the radio communication with high quality, a value of the return loss at a desired frequency is preferably less than a threshold.

A method for specifying the resonance frequency of the high frequency side is as follows. At first, a case of turning on a switch farthest from the feeding unit 111 and turning off the other switches is considered among a plurality of switches of the switch bank unit 116. At this time, since the loop length is maximized, the electric loop resonates at a lowest frequency $f_{Us}$ in the range of the high frequency side. In short, a lowest resonance frequency $f_{Us}$ is first determined. Then, when a switch to be turned on is sequentially switched to the other switches on the side nearer to the feeding unit 111, the resonance frequencies higher than $f_{Us}$ are sequentially determined. When a switch nearest to the feeding unit 111 is turned on, since the loop length is minimized, the electric loop resonates at a highest frequency $f_{Ue}$ in the range of the high frequency side.

On the other hand, a method for specifying the resonance frequency of the low frequency side is as follows. At first, there is considered a case where the LC resonance circuit 115 is absent, namely, a case where an end of the side in which the outer arm 113 is not connected to the feeding unit 111 is open. At this time, the electric loop resonates at a central frequency $f_{Lr}$ in the range of the low frequency side. In short, the central resonance frequency $f_{Lr}$ is first determined. Then, when the impedance is sequentially increased and decreased by the LC resonance circuit 115, resonance frequencies higher than $f_{Lr}$ and lower than $f_{Lr}$ are sequentially determined. As described above, the highest resonance frequency $f_{Le}$ and the lowest resonance frequency $f_{Ls}$ are determined in the range of the low frequency side.

Next, a specific example of operations of the outer arm 113 and the inner arm 114 will be described. At first, a single operation of the outer arm 113 will be described. Next, there will be described operations of the outer arm 113 and the inner arm 114 in the case where the outer arm 113 is not short-circuited by the LC resonance circuit 115. Finally, there will be described operations of the outer arm 113 and the inner arm 114 in the case where the outer arm 113 is short-circuited by the LC resonance circuit 115.

Figure 5:
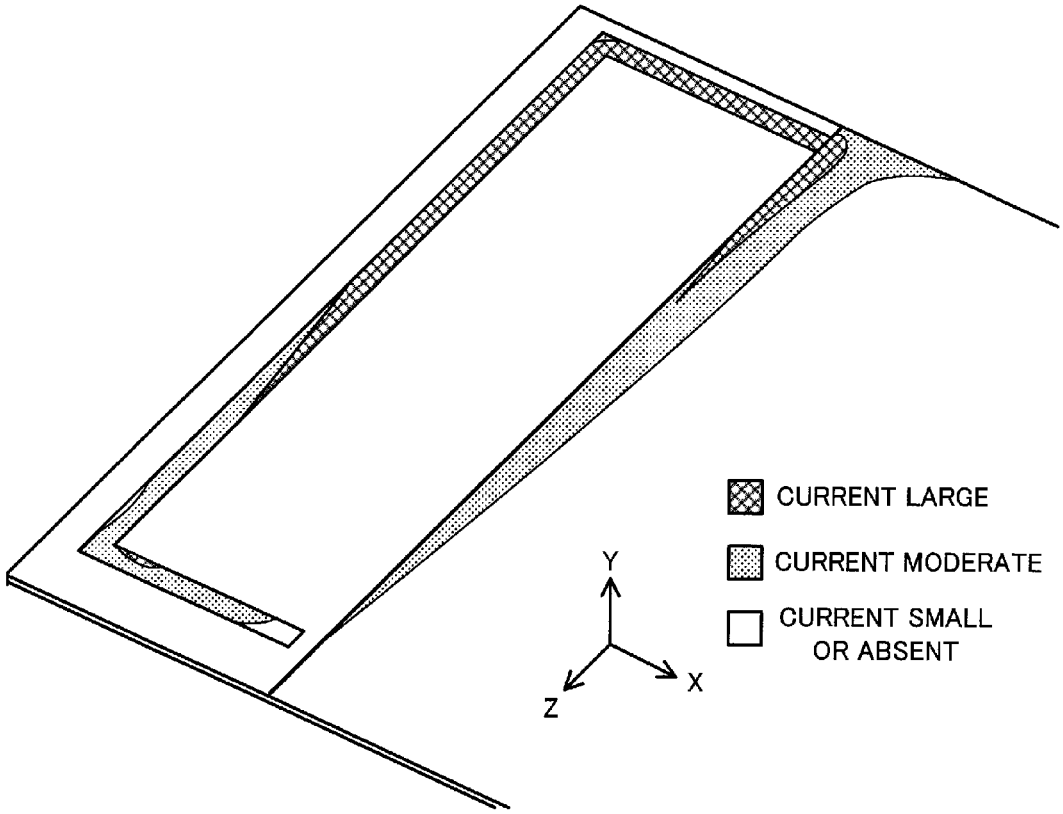
FIG. 5 illustrates an operation example of a bent arm.

FIG. 5 illustrates an operation example of a bent arm. As illustrated in FIG. 5, when considering a case of using the outer arm 113 independently, the outer arm 113 functions as a bent monopole antenna (an inverted-L antenna). Specifically, a relatively large current flows at the resonance frequency, on the short side of the feeding unit 111, near the feeding unit 111 side of the long side, and near the feeding unit 111 of the ground 120. Further, a moderate current flows on the short side of the open end side, near an open end of the long side, and on a portion apart from the feeding unit 111 of the ground 120.

Figure 6:
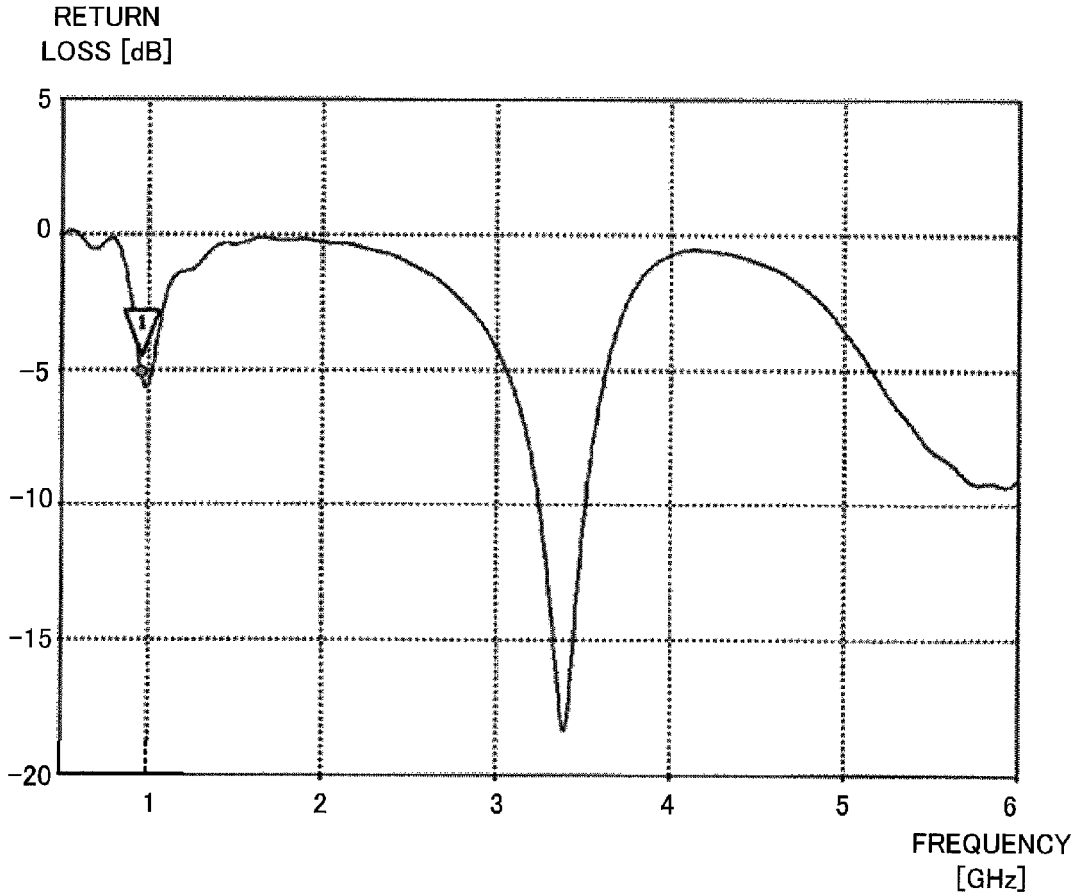
FIG. 6 is a graph illustrating an example of the return loss of the bent arm.

FIG. 6 is a graph illustrating an example of return loss of the bent arm. This graph illustrates a result in which the antenna with a shape illustrated in FIG. 5 is simulated. Here, a parameter of the arm length is set to L2=La2+2×Lf2=54 mm. As illustrated in FIG. 6, the resonance frequency (frequency indicated by an arrow of the graph) of the low frequency side is detected. The resonance wavelength at this time is approximately four times (approximately 216 mm) the arm length.

Figure 7:
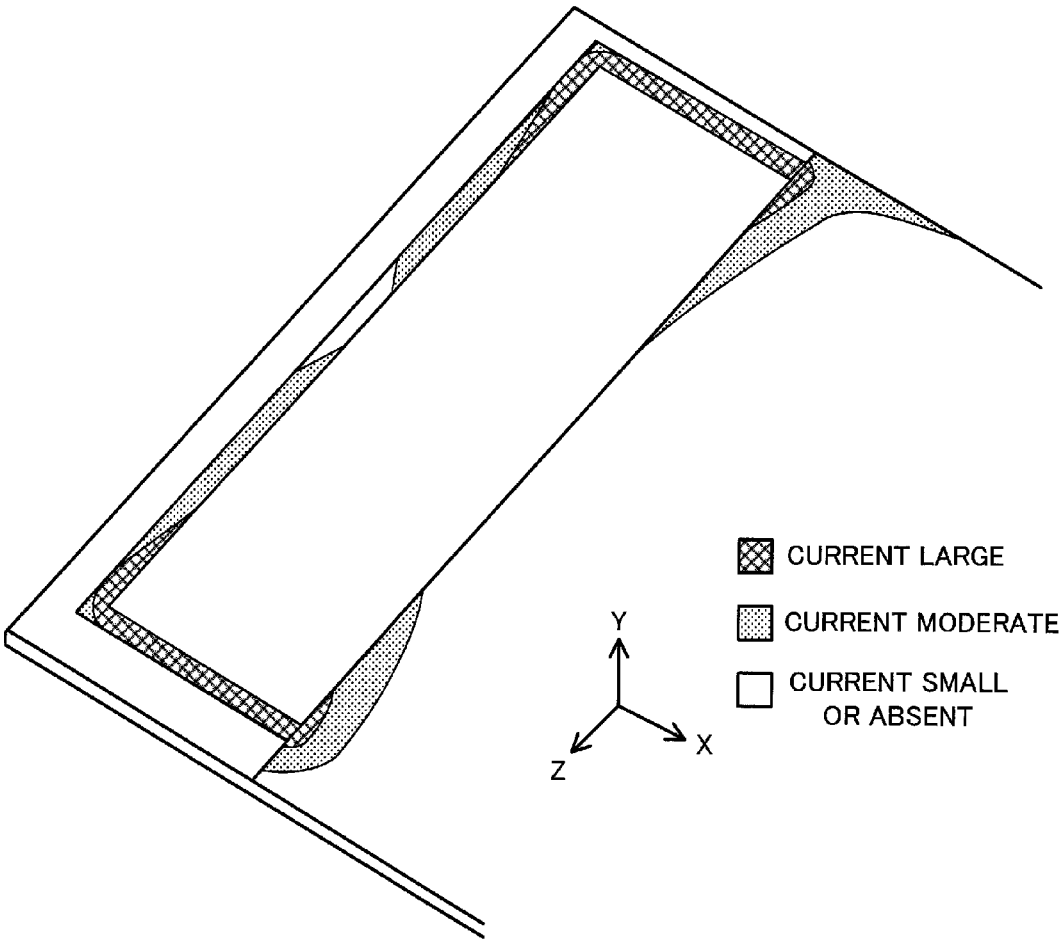
FIG. 7 illustrates an operation example of a bent and short-circuited arm.

FIG. 7 illustrates an operation example of a bent and short-circuited arm. The antenna illustrated in FIG. 7 differs from that of FIG. 5 in that an end of the side in which the outer arm 113 is not connected to the feeding unit 111 is short-circuited.

In this case, the outer arm 113 functions as a loop antenna. Specifically, a relatively large current flows at the resonance frequency, on two short sides, near bent points of the long side, near the feeding unit 111 of the ground 120, and near a short-circuiting point of the ground 120. Further, a moderate current flows on portions apart from the bent points of the long side, on a portion apart from the feeding unit 111 of the ground 120, and on a portion apart from a short-circuiting point of the ground 120. Note that a large current and a small current are relative levels in FIG. 7, and are not absolute levels capable of comparison with those of FIG. 5.

Figure 8:
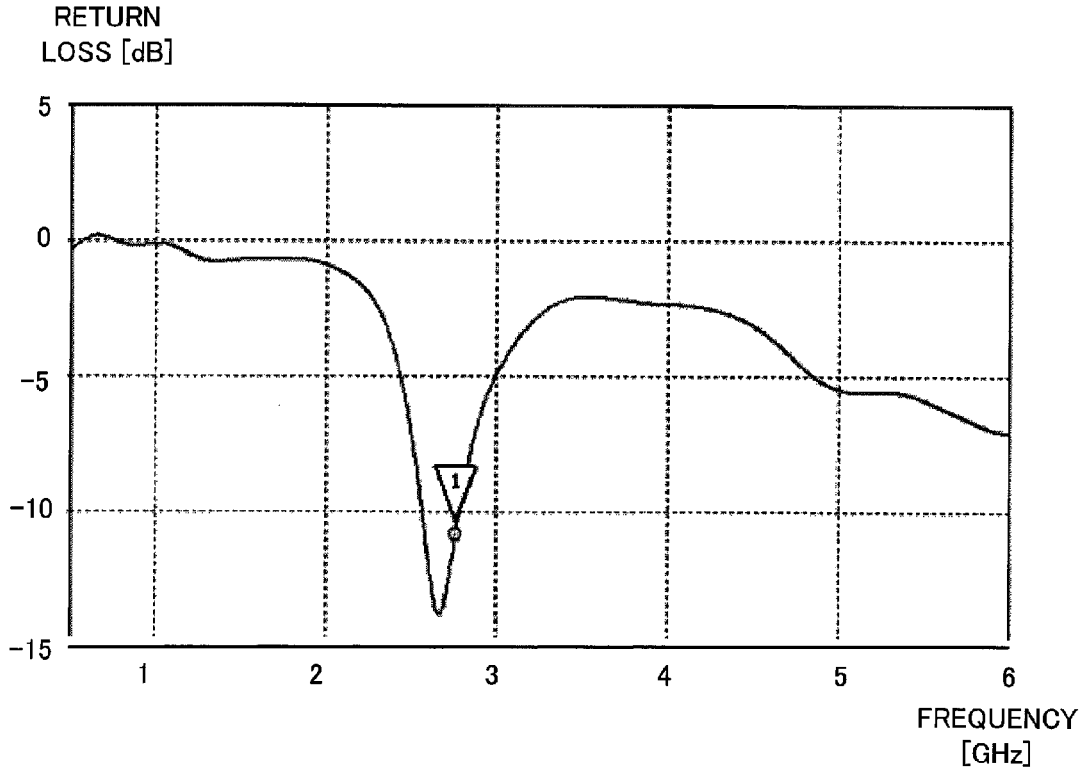
FIG. 8 is a graph illustrating an example of the return loss of the bent and short-circuited arm.

FIG. 8 is a graph illustrating an example of return loss of the bent and short-circuited arm. This graph illustrates a result in which the antenna with a shape illustrated in FIG. 7 is simulated. Here, a parameter of the loop length is set to 2×La2+2×Lf2=94 mm. As illustrated in FIG. 8, one resonance frequency (frequency indicated by an arrow of the graph) is detected. The resonance wavelength at this time is almost the same as (approximately 94 mm) that of the loop length.

Figure 9:
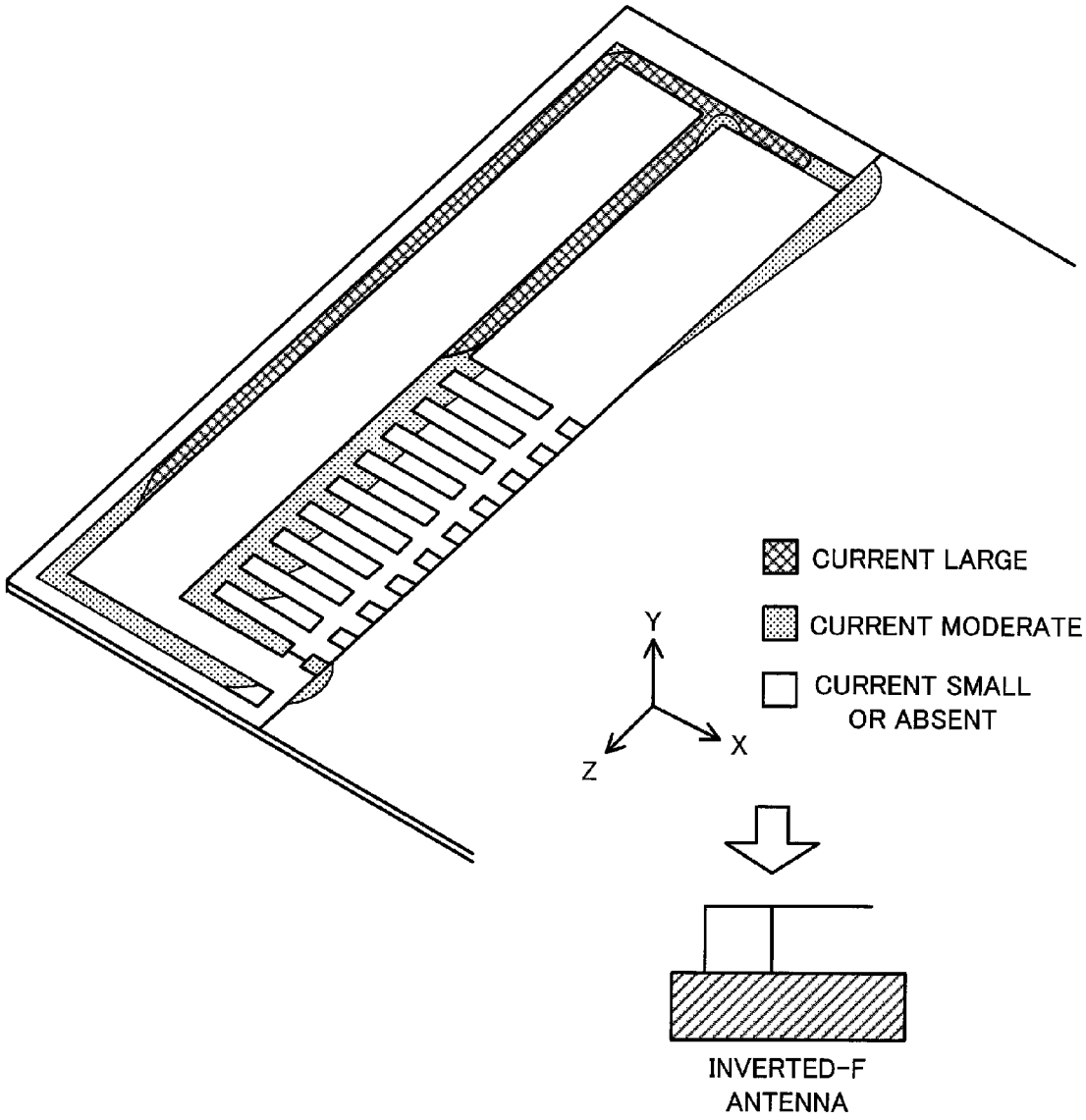
FIG. 9 illustrates an example of a surface current (low frequency) in a state where one end is open.

FIG. 9 illustrates an example of a surface current (low frequency) in a state where one end is open. As illustrated in FIG. 9, when considering the antenna 110 in which an end of the outer arm 113 is not electrically short-circuited, a combination of the outer arm 113 and the inner arm 114 functions as an inverted-F antenna at the low frequency (e.g., 0.96 GHz).

Specifically, a relatively large current flows at the resonance frequency of the low frequency side, on the short side of the feeding unit 111 side of the outer arm 113, near the feeding unit 111 of the long side of the outer arm 113, and near the feeding unit 111 of the inner arm 114. Further, a moderate current flows on the short side of the open end side of the outer arm 113, near the open end of the long side of the outer arm 113, near the switch bank unit 116 of the inner arm 114, near the feeding unit 111 of the ground 120, and near a switch for turning-on of the ground 120.

Note that in an example of FIG. 9, a switch farthest from the feeding unit 111 is turned on among a plurality of switches of the switch bank unit 116. The number of the switches is changed from that of an example of FIG. 3 (ten switches are provided). Further, a large current and a small current are relative levels in FIG. 9, and are not absolute levels capable of comparison with those of FIGS. 5 and 7.

Figure 10:
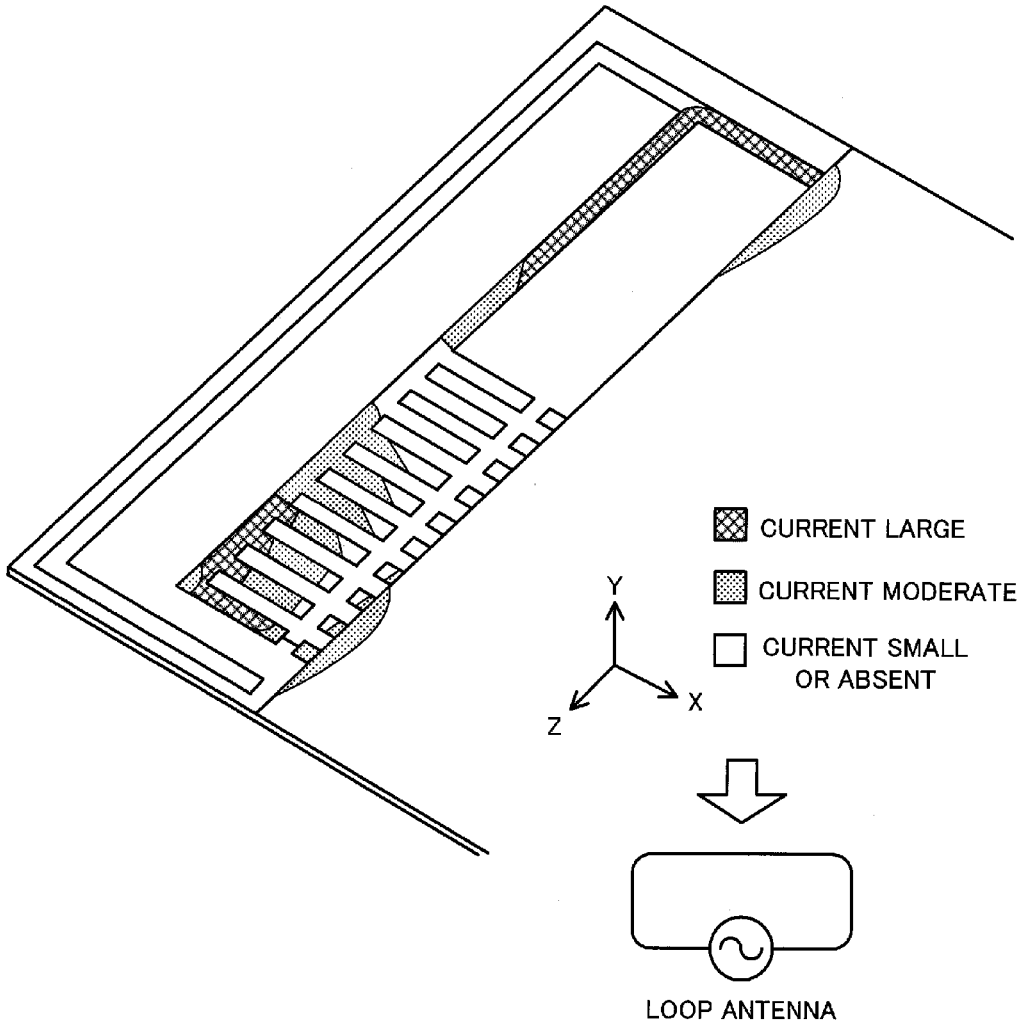
FIG. 10 illustrates an example of a surface current (high frequency) in a state where one end is open.

FIG. 10 illustrates an example of a surface current (high frequency) in a state where one end is open. A shape of the antenna is the same as that of FIG. 9. As illustrated in FIG. 10, the inner arm 114 functions as a loop antenna at a high frequency (e.g., 2.26 GHz). Only a small current flows on the long side of the outer arm 113 due to the presence of the inner arm 114.

Specifically, a relatively large current flows at the resonance frequency of the high frequency side, on a section between the feeding unit 111 of the outer arm 113 and a branch point to the inner arm 114, near the feeding unit 111 of the inner arm 114, and near a switch for turning-on of the inner arm 114. Further, a moderate current flows near a central portion of the inner arm 114, near the feeding unit 111 of the ground 120, and near a switch for turning-on of the ground 120. Note that a large current and a small current are relative levels in FIG. 10, and are not absolute levels capable of comparison with those of FIGS. 5, 7, and 9.

Figure 11:
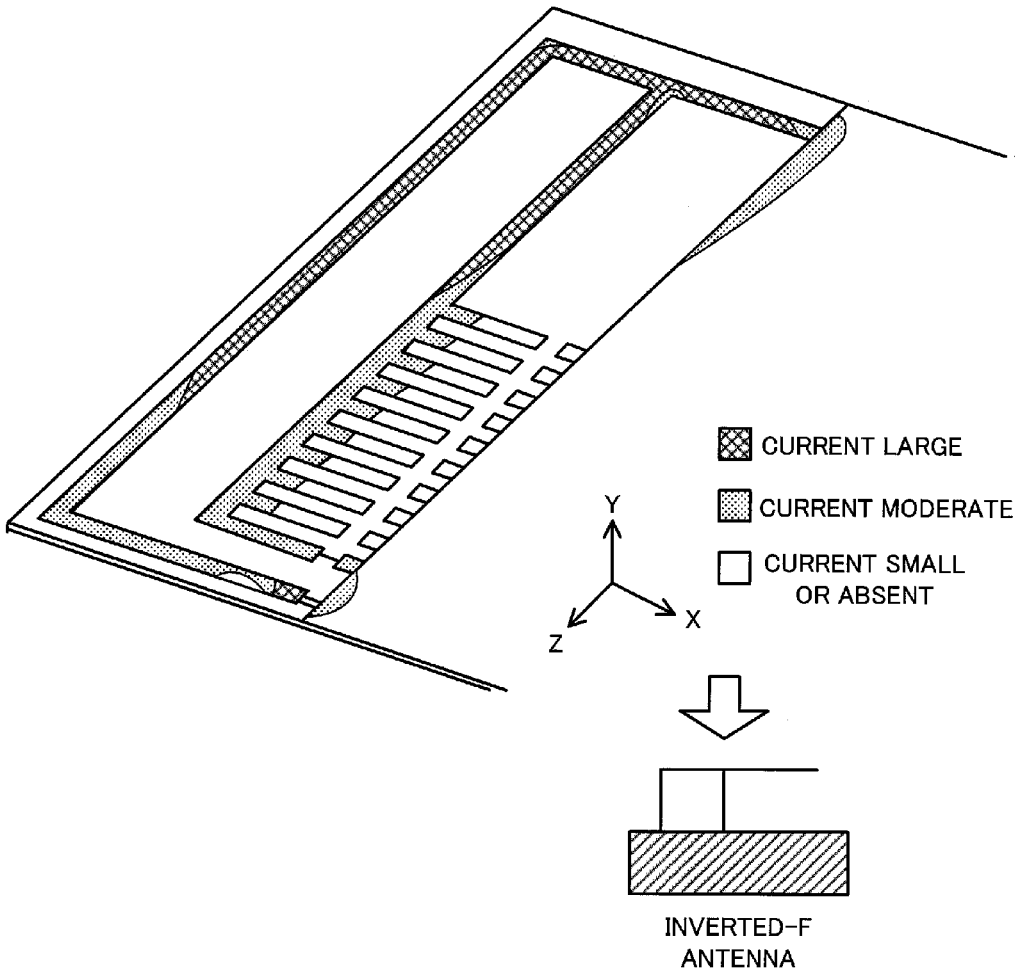
FIG. 11 illustrates an example of a surface current (low frequency) in a state where one end is short-circuited.

FIG. 11 illustrates an example of a surface current (low frequency) in a state where one end is short-circuited. As illustrated in FIG. 11, when considering the antenna 110 in which an end of the outer arm 113 is electrically short-circuited by the LC resonance circuit 115, the antenna 110 functions as an inverted-F antenna at a low frequency (e.g., 0.96 GHz) similarly to FIG. 9. That is, a relatively large current and a moderate current flow on the same portions as those illustrated in FIG. 9 at the resonance frequency of the low frequency side. In addition, a relatively large current flows near a short-circuiting point of the outer arm 113, and a moderate current flows near a short-circuiting point of the ground 120. Note that a large current and a small current are relative levels in FIG. 11, and are not absolute levels capable of comparison with those of FIGS. 5, 7, 9, and 10.

Figure 12:
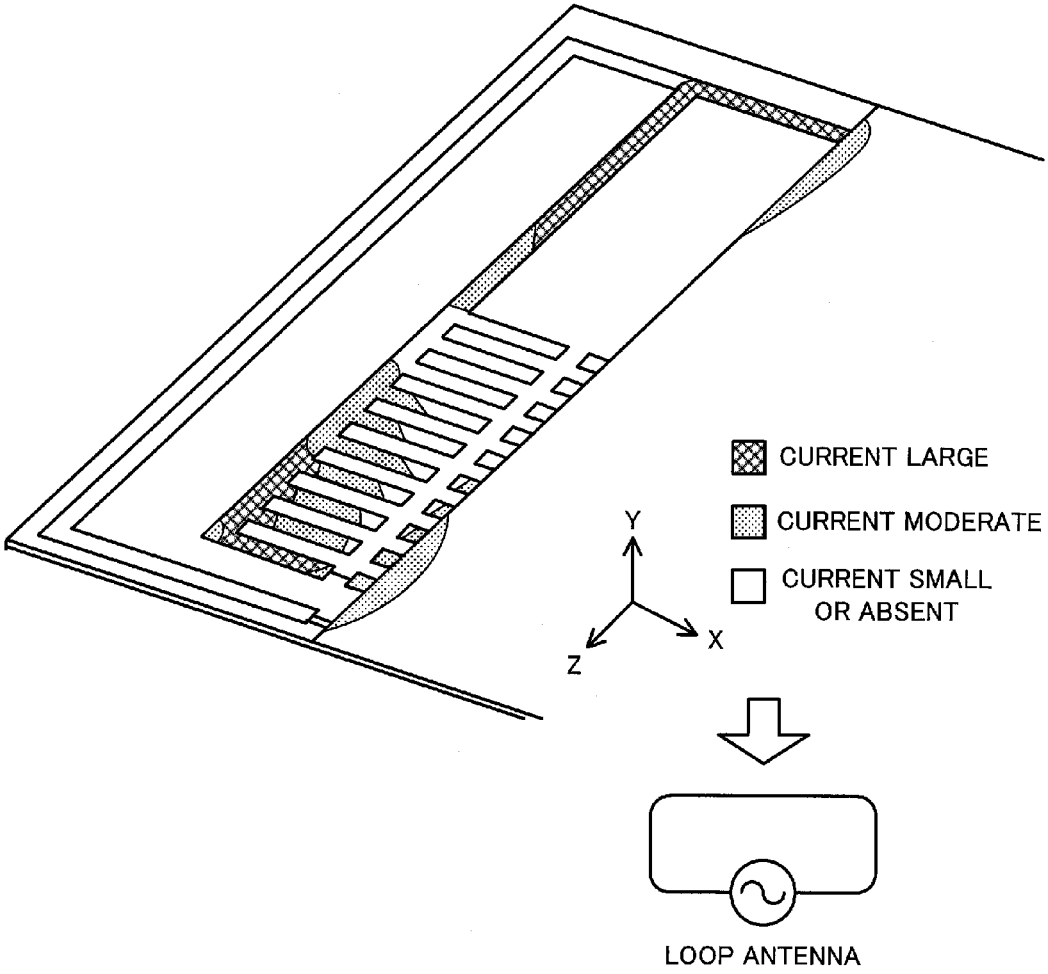
FIG. 12 illustrates an example of a surface current (high frequency) in a state where one end is short-circuited.

FIG. 12 illustrates an example of a surface current (high frequency) in a state where one end is short-circuited. As illustrated in FIG. 12, when considering the antenna 110 in which an end of the outer arm 113 is electrically short-circuited by the LC resonance circuit 115, the antenna 110 functions as a loop antenna at a high frequency (e.g., 2.26 GHz) similarly to FIG. 10. That is, a relatively large current and a moderate current flow on the same portions as those of FIG. 10 at the resonance frequency of the high frequency side. The outer arm 113 is prevented from functioning as a loop antenna due to the presence of the inner arm 114. Note that a large current and a small current are relative levels in FIG. 12, and are not absolute levels capable of comparison with those of FIGS. 5 and 7 and FIGS. 9 to 11.

As described above, also when the outer arm 113 is short-circuited by the LC resonance circuit 115, the antenna 110 functions as an inverted-F antenna at a low frequency and a loop antenna at a high frequency in the same manner as in the case where the outer arm 113 is not short-circuited by the LC resonance circuit 115. The resonance frequency of the low frequency side can be tuned by the LC resonance circuit 115.

Figure 13:
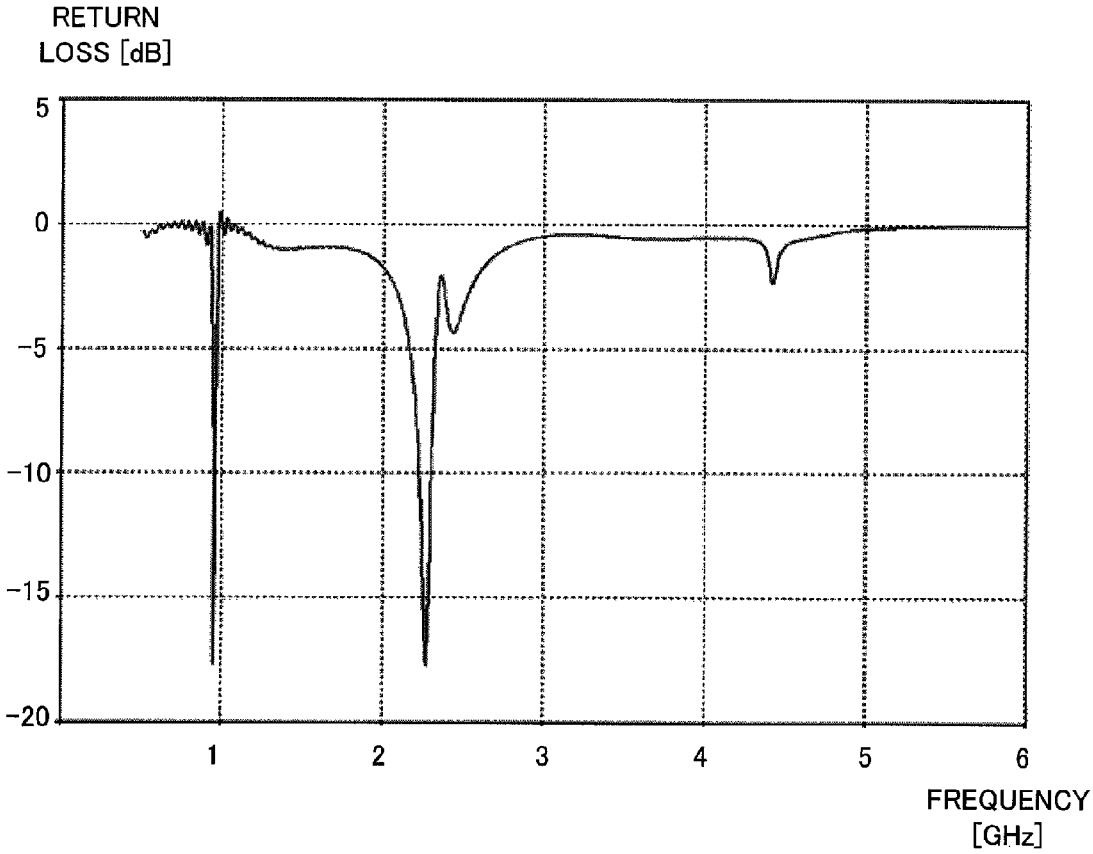
FIG. 13 is a graph illustrating an example of the return loss of the antenna.

FIG. 13 is a graph illustrating an example of return loss of the antenna. This graph illustrates a result in which the antenna with a shape illustrated in FIGS. 11 and 12 is simulated. As described above, the antenna 110 can realize two resonance frequencies of, for example, 0.96 GHz and 2.26 GHz. Here, 0.96 GHz being the resonance frequency of the low frequency side can be shifted by an operation of the LC resonance circuit 115. Further, 2.26 GHz being the resonance frequency of the high frequency side can be shifted by an operation of the switch bank unit 116. The tuning of the low frequency side and the high frequency side can be performed separately.

According to the second embodiment, the proposed antenna 110 permits the electric loop formed by the inner arm 114 to function as a loop antenna in the high frequency band. When switching a switch of the switch bank unit 116, a loop length can be changed and the resonance frequency of the high frequency side can be changed. Further, the antenna 110 permits a combination of the outer arm 113 and the inner arm 114 to function as an inverted-F antenna in the low frequency band. As a result, when changing the impedance by the LC resonance circuit 115, the antenna 110 permits the resonance frequency of the low frequency side to be changed separately from the resonance frequency of the high frequency side.

Further, the antenna 110 can be formed with one layer on one surface of the printed circuit board. This process permits an area on a surface of the printed circuit board to be effectively used, and miniaturization and weight saving of the radio communication apparatus 100 to be made easy. As described above, the radio communication apparatus 100 is particularly preferable as a radio terminal device that performs broadband radio communications.

The proposed antenna and radio communication apparatus according to the embodiment make easy tuning in a wide range of frequency.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that various changes, substitutions and alterations could be made hereto without departing from the spirit and scope of the invention.

What is claimed is:

1. An antenna comprising:

a first arm unit whose one end is connected to a feeding unit;

a resonance circuit with a variable impedance, whose one end is connected to another end of the first arm unit, and whose other end is connected directly to ground;

a second arm unit whose one end is connected to the first arm unit at a position that is away from the one end of the first arm unit, the second arm unit having a plurality of other ends opposite to the one end connected to the first arm unit; and a switch bank unit placed between the second arm unit and the ground, the switch bank unit including a plurality of switches configured to selectively connect one of the plurality of other ends of the second arm unit to the ground, wherein the second arm unit and switch bank unit reside within a space enclosed by the first arm unit, resonance circuit, and ground.

2. The antenna according to claim 1, wherein:

the first arm unit is bent at two points between the feeding unit and the resonance circuit.

3. A radio communication apparatus comprising:

a first arm unit whose one end is connected to a feeding unit;

a resonance circuit with a variable impedance, whose one end is connected to another end of the first arm unit, and whose other end is connected directly to ground;

a second arm unit whose one end is connected to the first arm unit at a position that is away from the one end of the first arm unit, the second arm unit having a plurality of other ends opposite to the one end connected to the first arm unit; and a switch bank unit placed between the second arm unit and the ground, the switch bank unit including a plurality of switches configured to selectively connect one of the plurality of other ends of the second arm unit to the ground, wherein the second arm unit and switch bank unit reside within a space enclosed by the first arm unit, resonance circuit, and ground, and wherein the first arm unit, the second arm unit, the resonance circuit, switch bank unit, and the ground are formed on a single surface of a substrate.

* * * * *